US008393718B2

(12) United States Patent
Kida et al.

(10) Patent No.: US 8,393,718 B2
(45) Date of Patent: Mar. 12, 2013

(54) INKJET HEAD AND IMAGE FORMING APPARATUS HAVING THE SAME

(75) Inventors: Hitoshi Kida, Kanagawa (JP); Takeshi Takemoto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/229,880

(22) Filed: Sep. 12, 2011

(65) Prior Publication Data

US 2012/0069095 A1 Mar. 22, 2012

(30) Foreign Application Priority Data

Sep. 16, 2010 (JP) ..... 2010-207735

(51) Int. Cl.
*B41J 2/045* (2006.01)

(52) U.S. Cl. ..... 347/71

(58) Field of Classification Search ..... 347/50, 347/54, 68, 70, 71, 72
See application file for complete search history.

(56) References Cited

U.S. PATENT DOCUMENTS 6,802,597 B2 * 10/2004 Furuhata ..... 347/71

FOREIGN PATENT DOCUMENTS

JP 2006-116767 5/2006
JP 2009-267428 11/2009

* cited by examiner

*Primary Examiner* — An Do
(74) *Attorney, Agent, or Firm* — Oblon, Spivak, McClelland, Maier & Neustadt, L.L.P.

(57) ABSTRACT

An inkjet head includes: an ink tank plate that includes a nozzle to discharge a liquid; a drive circuit member connected to an electromechanical transducer to apply a voltage to the electromechanical transducer to generate a pressure in an ink tank to discharge a liquid from the nozzle; a liquid supply plate stacked approximately in parallel with the drive circuit member on the ink tank plate; and a sealing material that hermetically seals an electrical connection between the drive circuit member and the wiring member. The liquid supply plate is provided with a receptacle having a hole portion or a concave portion and a mount area surrounded by the receptacle. The drive circuit member is received in the mount area. The sealing material is filled inside the mount area after the liquid supply plate is bonded to the ink tank plate.

5 Claims, 6 Drawing Sheets

INKJET HEAD AND IMAGE FORMING APPARATUS HAVING THE SAME

CROSS-REFERENCE TO RELATED APPLICATIONS

The present application claims priority to and incorporates by reference the entire contents of Japanese Patent Application No. 2010-207735 filed in Japan on Sep. 16, 2010.

BACKGROUND OF THE INVENTION

1. Field of the Invention

The present invention relates to an inkjet head in which a drive circuit member is mounted on a laminated-type inkjet head member, and an image forming apparatus having the same.

2. Description of the Related Art

In the related art, as a type of printer, there is known an inkjet printer that prints on a medium such as a paper sheet by moving an inkjet head, which discharges a liquid such as ink, relative to the medium.

In order to selectively drive nozzles that discharge droplets in inkjet heads mounted in inkjet printers, a drive circuit member including a drive integrated circuit (IC) is used. The drive circuit member is connected to an electromechanical transducer such as a piezoelectric element or a heater which generates force to discharge the liquid. As for techniques for mounting the drive circuit member, there is some known techniques, a flip chip bonding technique, a wire bonding technique, and so on.

As such an inkjet head, the following structure is known. The structure includes a pressure generating chamber communicating with a nozzle; a vibrating plate forming a part of the pressure generating chamber; a piezoelectric element which is arranged in the vibrating plate, particularly in the surface opposing the pressure generating chamber and which generates a change in the internal pressure of the pressure generating chamber; and a drive circuit member having a drive element to drive the piezoelectric element. In the structure, the drive circuit member is bonded to a terminal provided in the piezoelectric element using the flip chip bonding technique, and is mounted on an ink tank plate as a fluid path forming plate. Furthermore, a liquid supply plate as a protection plate is bonded to the ink tank plate (for example, refer to Japanese Patent Application Laid-open No. 2006-116767).

There is also known an inkjet head in which the drive circuit member is mounted through a wire connector after the liquid supply plate is bonded to the ink tank plate (for example, refer to Japanese Patent Application Laid-open No. 2009-267428).

However, since the sealing material to be coated on the ink tank plate to protect a connector portion of the drive circuit member is apt to wetly spread, it wetly spreads on the ink tank plate. Therefore, in a case where a liquid supply plate as a protection plate is bonded to the ink tank plate as in the inkjet head disclosed in Japanese Patent Application Laid-open No. 2009-267428, it is necessary to avoid an area where the sealing material wetly spreads in order to obtain an excellent bonding state without any void. This results in the inkjet head having a large size. Since the area where no wet-spreading of the sealing material appears is not supported by the liquid supply plate, the inkjet head has a weak structural strength there and hence is susceptible to deformation caused by an external force, resulting in the reliability being not guaranteed.

Similarly, in the inkjet head disclosed in Japanese Patent Application Laid-open No. 2009-267428, in a case where another member is additionally stacked on the liquid supply plate where the drive circuit member is mounted, the member must be stacked avoiding the area where the sealing material wetly spreads. This causes a large-sized head and reduces a structural strength.

In addition, since it is necessary to perform mounting, typically, at a high temperature of 150° C. to 300° C. in order to increase the strength of the electrical connection portion of the drive circuit member, an adhesive used to bond other members may be degraded to generate bonding errors, or a material which can be used as a constituent member is problematically limited to those having heat resistance.

SUMMARY OF THE INVENTION

It is an object of the present invention to at least partially solve the problems in the conventional technology.

According to an aspect of the present invention, there is provided an inkjet head that includes: an ink tank plate that includes a nozzle configured to discharge a liquid and an ink tank of which a portion is formed by a vibrating plate provided with an electromechanical transducer; a drive circuit member connected to the electromechanical transducer through a wiring member to apply a voltage to the electromechanical transducer so as to generate a pressure in the ink tank to discharge a liquid from the nozzle; a liquid supply plate stacked approximately in parallel with the drive circuit member on the ink tank plate to guide a liquid to the ink tank; and a sealing material that hermetically seals an electrical connection between at least the drive circuit member and the wiring member. The liquid supply plate is provided with a receptacle having a hole portion or a concave portion, and a mount area surrounded by the receptacle formed on the ink tank plate, the drive circuit member is received in the mount area, and the sealing material is provided to be filled inside the mount area after the liquid supply plate is bonded to the ink tank plate.

According to another aspect of the present invention, there is provided an image forming apparatus that includes the inkjet head mentioned above.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an inkjet head and an image forming apparatus having the same according to embodiments will be described in detail.

First Embodiment

First, an inkjet head according to the first embodiment will be described.

Figure 1:
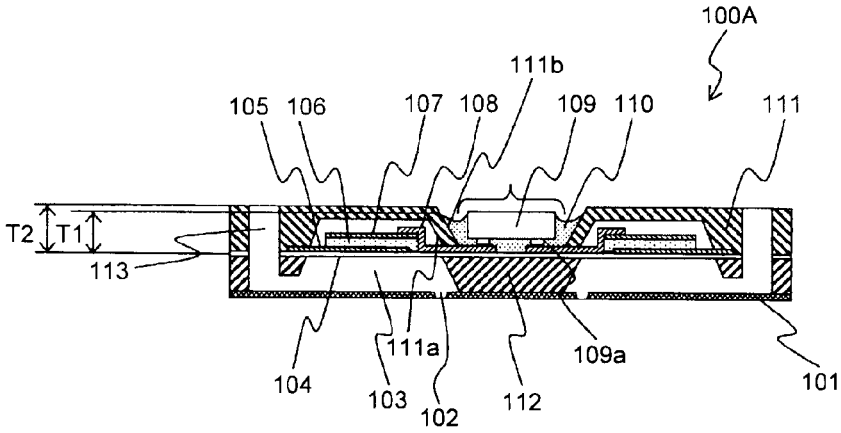
FIG. 1 is a cross-sectional view illustrating an inkjet head according to a first embodiment.

Referring to FIG. 1, an inkjet head 100A according to the first embodiment has an ink tank plate 112. A nozzle plate 101 is boned to the lower surface of the ink tank plate 112; and a vibrating plate 104 is bonded to the upper surface of the ink tank plate 112. In addition, a plurality of ink tanks 103 surrounded by the nozzle plate 101 and the vibrating plate 104 are formed in the ink tank plate 112.

The nozzle plate 101 has a plurality of open nozzles 102 from which droplets are discharged. Each of the nozzles 102 communicates with the ink tank 103.

The vibrating plate 104 serving as a part of each ink tank 103 is made of an elastic material. In the vibrating plate 104, particularly on the upper surface which is the opposite side from the ink tank 103, a lower electrode 105 connected to the ground is disposed.

The upper portion of the lower electrode 105 is provided with an electromechanical transducer 106 made from a piezoelectric element such as a piezo element. An upper electrode 107 is provided on the top of the electromechanical transducer 106. An extraction electrode (wiring member) 108 extends from the upper electrode 107; and the extraction electrode 108 is wired between each ink tank 103 on the upper surface of the ink tank plate 112. A drive circuit member 109 as a drive IC is mounted between each ink tank 103 on the upper surface of the ink tank plate 112; and the drive circuit member 109 is electrically connected to the extraction electrode 108.

The drive circuit member 109 is mounted using a flip chip bonding technique; and the extraction electrode 108 is electrically connected to a terminal of the drive circuit member 109 using a bump 109*a*. The drive circuit member 109 may be mounted using a wire bonding technique.

The inkjet head 100A has a liquid supply plate 111 in approximately the same step layer so as to be flush with the upper surface of the ink tank plate 112 where the drive circuit member 109 is mounted. The liquid supply plate 111 is bonded to the ink tank plate 112. In the liquid supply plate 111, a concave portion 111*a* is formed in a location corresponding to the electromechanical transducer 106 in the ink tank plate 112 side. The electromechanical transducer 106 is received by the concave portion 111*a*.

The liquid supply plate 111 is provided with a receptacle hole (receptacle) 111*b* penetrating from top to bottom in a location between each ink tank 103; and the drive circuit member 109 is arranged inside the receptacle 111*b*. That is, the drive circuit member 109 is mounted in the mount area A on the ink tank plate 112 surrounded by the receptacle 111*b* in the liquid supply plate 111.

The drive circuit member 109 mounted in the mount area A has a thickness T1 smaller than the thickness T2 of the liquid supply plate 111. As a result, the upper surface of the drive circuit member 109 is arranged to be lower than the upper surface of the liquid supply plate 111.

In addition, a viahole (communicating hole) 113 communicated with the ink tank 103 is formed in the liquid supply plate 111. A liquid such as ink is supplied from a liquid tank (not shown) to the viahole 113. The liquid supplied to the viahole 113 is fed to the ink tank 103.

Meanwhile, in a case where the drive circuit member 109 is mounted using a flip chip bonding technique or a wire bonding technique, it is necessary to prevent a fracture caused by the stress of the electrical connection with respect to a thermal stress such as a heat cycle and a physical stress such as impact or bending and is necessary to improve connection reliability. For this reason, the mount area A is filled with a sealing material such as an underfill material; and the circumference including the electrical connections connected to the extraction electrodes 108 of the drive circuit member 109 is covered by and sealed with a sealing material 110. As a result, the connection reliability between the drive circuit member 109 and the extraction electrode 108 is guaranteed.

While it is necessary to heat the sealing material 110 for curing, a baking temperature for curing the sealing material 110 is typically set to, approximately, 170° C. Recently, a sealing material that can be cured at a temperature of about 70 to 100° C. has been developed.

In the inkjet head 100A, a plurality of the structures described above are arranged line by line on the same surface, and driven by a predetermined drive circuit member 109 based on signals transmitted from a controller (not shown).

Specifically, a voltage is applied from the drive circuit member 109 to the upper electrode 107 to deform the electromechanical transducer 106 so that a volume of the ink tank 103 is changed through the vibrating plate 104. As a result, the internal side of the ink tank 103 is pressurized, and a liquid is discharged from a selected nozzle 102.

Next, a process of assembling the inkjet head 100A mentioned above will be described.

Figure 2A:
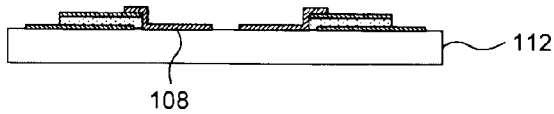
FIGS. 2A to 2D are schematic cross-sectional views illustrating a process of assembling an inkjet head according to the first embodiment.
Figure 2B:
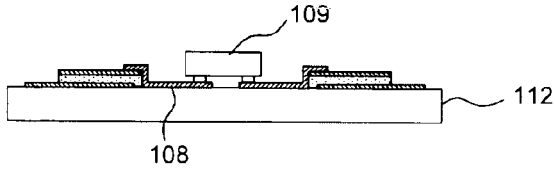

In order to assemble the aforementioned inkjet head 100A, the drive circuit member 109 is mounted, as shown in FIG. 2B, on the ink tank plate 112 including a nozzle plate 101, a vibrating plate 104, an electromechanical transducer 106, and an extraction electrode 108 as shown in FIG. 2A.

Figure 2C:
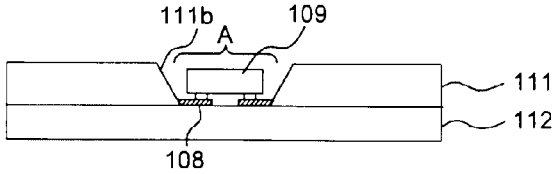

Then, as shown in FIG. 2C, the liquid supply plate 111 is bonded onto the ink tank plate 112 from the upper side thereof. As a result, a mount area A is formed on the ink tank plate 112 by means of the receptacle 111*b* of the liquid supply plate 111; and the drive circuit member 109 is arranged inside the mount area A.

Figure 2D:
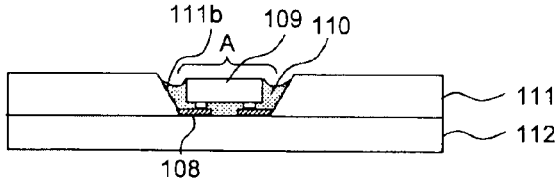

In this situation, as shown in FIG. 2D, the sealing material 110 is discharged from a sealing material supply needle to fill the mount area A. The circumference including the electrical connections connected to the extraction electrodes 108 of the drive circuit member 109 is hermetically sealed with the sealing material 110 in the mount area A.

In this case, the sealing material 110 filling the mount area A wetly spreads on the ink tank plate 112 inside the mount area A. However, since the mount area A is surrounded by the receptacle 111*b* of the liquid supply plate 111, the sealing material 110 stops at the wall surface of the receptacle 111*b*, and does not wetly spread over the wall surface.

Next, another process of assembling the inkjet head 100A will be described.

Figure 3A:
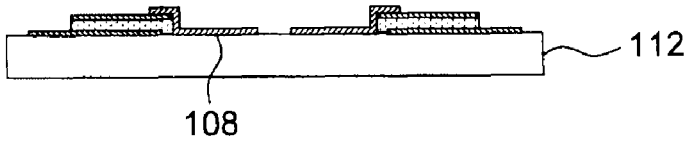
FIGS. 3A to 3D are schematic cross-sectional views illustrating another process of assembling an inkjet head according to the first embodiment.
Figure 3B:
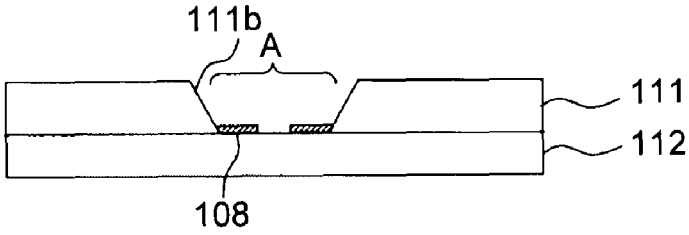

In the process of assembling the inkjet head 100A, as shown in FIG. 3B, the liquid supply plate 111 is bonded onto the ink tank plate 112 having the nozzle plate 101, the vibrating plate 104, the electromechanical transducer 106, and the extraction electrode 108 as shown in FIG. 3A from the upper side thereof. As a result, the mount area A is formed on the ink tank plate 112 by means of the receptacle 111*b* of the liquid supply plate 111.

Figure 3C:
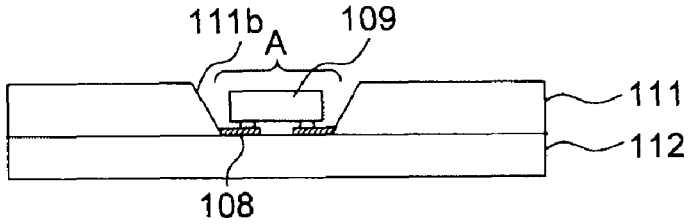

Then, as shown in FIG. 3C, the drive circuit member 109 is mounted in the mount area A in the ink tank plate 112 so that the drive circuit member 109 is arranged in the mount area A.

Figure 3D:
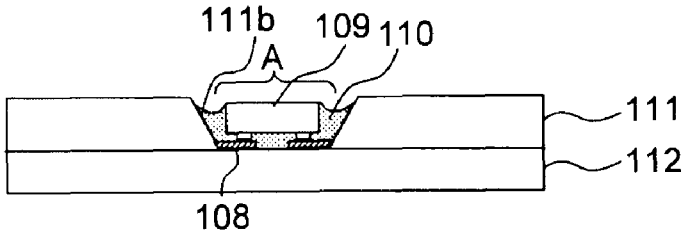

In this situation, as shown in FIG. 3D, the sealing material 110 is discharged from the sealing material supply needle to fill the mount area A with the sealing material 110; and the circumference including the electrical connections connected to the extraction electrodes 108 and the drive circuit member 109 is hermetically sealed with the sealing material 110 inside the mount area A.

Similarly, in this case, the sealing material 110 filling the mount area A wetly spreads on the ink tank plate 112 inside the mount area A. However, since the mount area A is surrounded by the receptacle 111*b* of the liquid supply plate 111, the sealing material 110 stops at the wall surface of the receptacle 111*b*, and not wetly spreads over the wall surface.

Figure 4A:
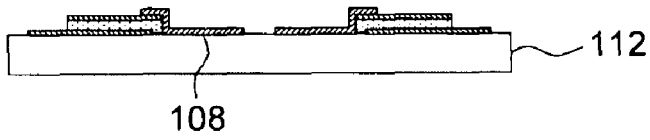
FIGS. 4A to 4D are schematic cross-sectional views illustrating still another process of assembling an inkjet head according to the first embodiment.
Figure 4B:
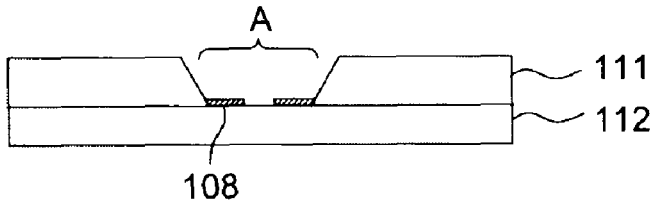
Figure 4C:
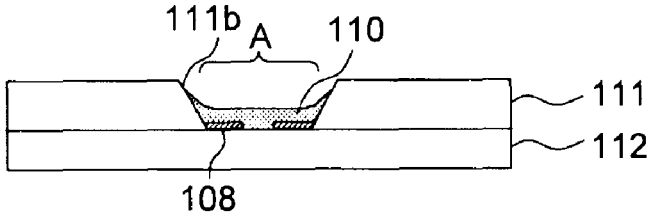
Figure 4D:
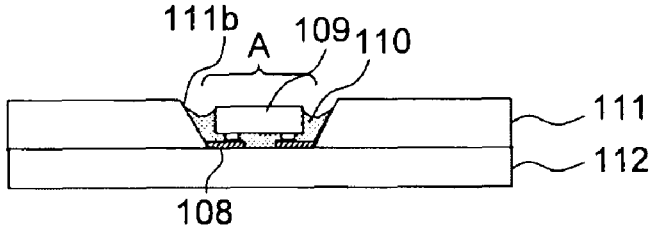

Alternatively, the liquid supply plate 111 may be bonded onto the ink tank plate 112 having the nozzle plate 101, the vibrating plate 104, the electromechanical transducer 106, and the extraction electrode 108 as shown in FIG. 4A from the upper side thereof to form the mount area A as shown in FIG. 4B. Then, as shown in FIG. 4C, the sealing material 110 may be provided to fill the mount area A. Then, as shown in FIG. 4D, the drive circuit member 109 may be mounted in the mount area A, and the drive circuit member 109 may be mounted in the mount area A. Even in this case, the circumference including the electrical connections connected to the extraction electrodes 108 of the drive circuit member 109 can be hermetically sealed with the sealing material 110 inside the mount area A.

Similarly, in this case, while the sealing material 110 filling in the mount area A wetly spreads on the ink tank plate 112 in the mount area A, since the mount area A is surrounded by the receptacle 111*b* of the liquid supply plate 111, the sealing material 110 stops at the wall surface of the receptacle 111*b*, and does not wetly spread over the wall surface.

In addition, it is possible to assemble the inkjet head 100A easily and smoothly using any one of the aforementioned assembling processes.

Figure 5A:
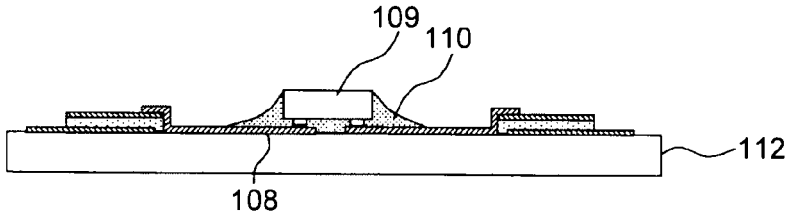
FIGS. 5A and 5B are schematic cross-sectional views illustrating a process of assembling an inkjet head according to a reference example.
Figure 5B:
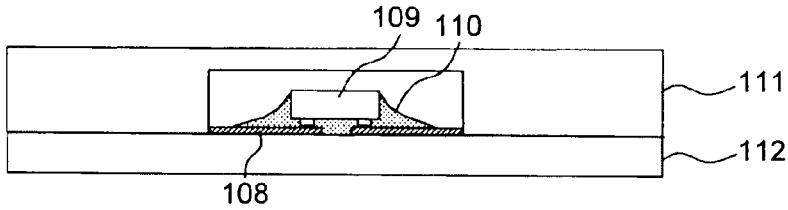

Here, since the sealing material 110 is apt to wetly spread, if the sealing material 110 is provided to fill an area on the ink tank plate 112 before the liquid supply plate 111 is bonded onto the ink tank plate 112, the sealing material 110 wetly spreads on the ink tank plate 112 as shown in FIG. 5A. Therefore, in a case where the liquid supply plate 111 is bonded onto the ink tank plate 112 after the sealing material 110 is provided to fill an area on the ink tank plate 112, it is necessary to bond the liquid supply plate 111 in an area where the sealing material 110 does not wetly spread as shown in FIG. 5B. For this reason, a support of the liquid supply plate 111 in the vicinity of a mount region of the drive circuit member 109 is removed so that a structural strength is reduced, deformation is easily generated by an external force, and reliability is degraded.

In this regard, since the sealing material 110 is provided for filling after the liquid supply plate 111 is bonded onto the ink tank plate 112 in the inkjet head 100A according to the first embodiment, it is unnecessary to provide a back clearance corresponding to the area where the sealing material 110 wetly spreads on the ink tank plate 112 to fill the liquid supply plate 111 with the sealing material 110, compared to a case where the liquid supply plate 111 is bonded to the ink tank plate 112 after the sealing material 110 is provided for filling. Therefore, it is possible to miniaturize the head and guarantee high reliability. In addition, since the amount of materials is reduced due to miniaturization, it is possible to reduce costs. Particularly, since miniaturization increases the number of components obtained per single wafer when components are cut out from a wafer, it is possible to reduce costs.

Although the drive circuit member 109 in the aforementioned inkjet head 100A may be mounted using other techniques such as a wire bonding technique, it is preferably to employ a flip chip bonding technique due to a short mounting time such as several seconds or several tens of seconds. In addition, if the drive circuit member 109 is mounted using such a flip chip bonding technique, it is possible to reduce a take time.

Here, in a case where the ink tank plate 112 and the liquid supply plate 111 are bonded using an adhesive, if the heating temperature for curing the sealing material 110 is too high, the adhesive used to bond the ink tank plate 112 and the liquid supply plate 111 is degraded, and a bonding strength thereof may be reduced. Therefore, as the sealing material 110, those that can be cured at a low temperature are preferably employed. If such a low-temperature curable sealing material 110 is employed, the hermetical sealing can be obtained at a low temperature. Therefore, it is possible to prevent degradation of the adhesive used to bond the ink tank plate 112 and the liquid supply plate 111, and is possible to guarantee high reliability. However, such as low-temperature curable sealing material 110 may not be suitable for a case where the ink tank plate 112 and the liquid supply plate 111 are bonded through solid-phase diffusion and the like.

More preferably, before the liquid supply plate 111 is bonded, the drive circuit member 109 is mounted on the ink tank plate 112 at a high temperature (for example, 250° C.), and the liquid supply plate 111 is bonded. Then, the drive circuit member 109 is hermetically sealed using a low-temperature curable sealing material 110 at a temperature lower than that used to mount the drive circuit member 109 (for example, 150° C.). As a result, it is possible to improve the bonding reliability of the drive circuit member 109, and it is unnecessary to be anxious about degradation of the adhesive used to bond the ink tank plate 112 and liquid supply plate 111. Therefore, it is possible to obtain further higher reliability.

Typically, in order to obtain sufficient strength of the electrical connection for practical use in the flip-chip mounting using bumps, or using metal solid-phase diffusion bonding and ACF heating, heating at a temperature of 200° C. to 300° C. is necessary. In the thermal press-bonding at a temperature of about 100° C. at which the adhesive used to assemble the inkjet head 100A can endure, a bonding strength between bumps and pads is too small to obtain metallic bonding within a bonding time (for example, 0.5 to 3 seconds) or under a welding pressure (about 3 to 5 N per single bump) used in practice considering the deformation amount of the bumps.

In order to increase the bonding strength in the low-temperature mounting, it is necessary to apply ultrasonic vibration to the drive circuit member 109 under the aforementioned condition. Typically, in order to obtain a sufficient bonding strength, it is necessary to perform mounting by applying ultrasonic waves at a temperature of room temperature to 200° C. so that a high bonding strength, about 2 N per single bump, can be obtained, and metallic bonding can be obtained on the entire surface of the bonding area. Then, in a shear test, it was recognized that there is no fracture in a bonding interface between an Au ball bump and an Au pad, but there is a fracture in a bonding interface with the Al pad. In the shear test performed for the remaining Au ball bumps, it was recognized that there is no fracture in a bonding interface with the Au pad, but there is a fracture in the bumps.

The Au pad and the Au wire are also metallically bonded by applying ultrasonic waves for wire bonding. In this case, heating at a temperature of about 150° C. to 300° C. is necessary in order to obtain a sufficient bonding strength.

Next, an inkjet head 100A having a frame will be described.

Figure 6:
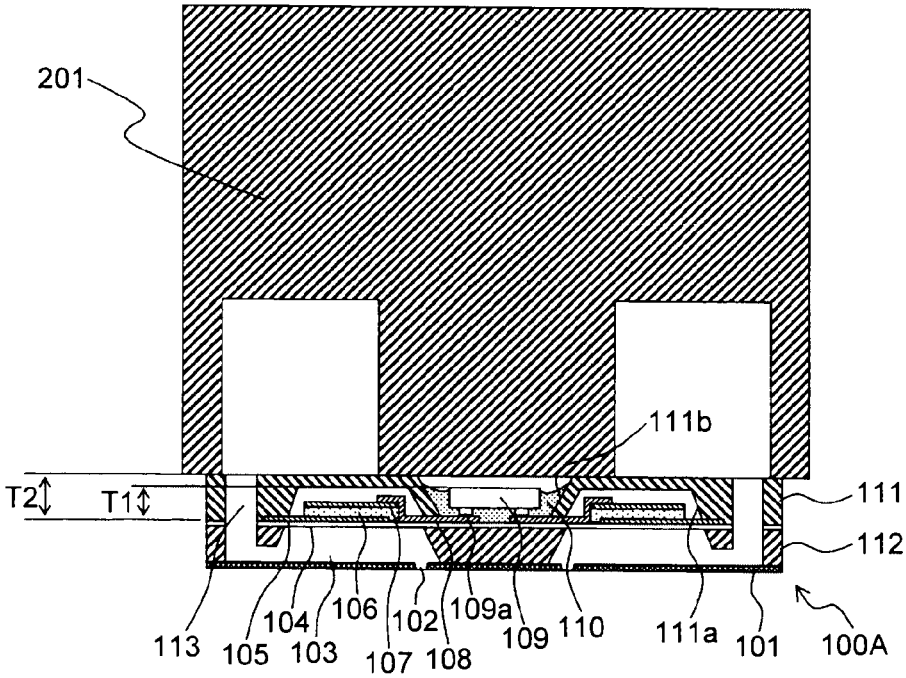
FIG. 6 is a cross-sectional view illustrating an inkjet head having a frame according to a first embodiment.

As shown in FIG. 6, a frame 201 is bonded on top of the inkjet head 100A.

Here, as described above, in the inkjet head 100A, the thickness T1 of the drive circuit member 109 mounted in the mount area A is smaller than the thickness T2 of the liquid supply plate 111. As a result, the upper surface of the drive circuit member 109 is arranged to be lower than the upper surface of the liquid supply plate 111.

Therefore, even when the frame 201 is bonded on top of the inkjet head 100A, it is possible to prevent contact between the frame 201 and the drive circuit member 109.

As such, in the inkjet head 100A, the thickness T1 of the drive circuit member 109 mounted in the mount area A is smaller than the thickness T2 of the liquid supply plate 111; and the upper surface of the drive circuit member 109 is arranged to be lower than even the upper surface of the liquid supply plate 111. Therefore, in a case where the frame 201 is bonded to the upper surface, the back clearance for preventing contact between the frame 201 and the drive circuit member 109 is dispensable. That is, it is possible to planarize the bonding surface of the bonding frame 201, reduce the number of processes, and lower costs.

Second Embodiment

Next, an inkjet head according to the second embodiment will be described.

In the following description, same reference numerals denote same elements as in the inkjet head 100A according to the first embodiment, and description thereof will not be repeated.

Figure 7:
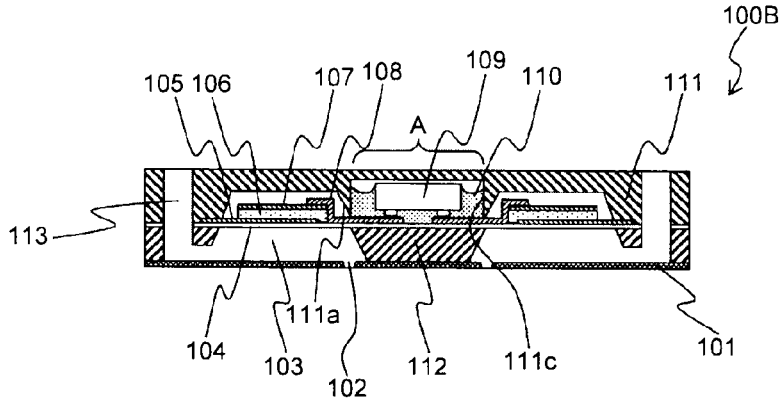
FIG. 7 is a cross-sectional view illustrating an inkjet head according to a second embodiment.

Referring to FIG. 7, in an inkjet head 100B according to the second embodiment, a receipt concave portion (receptacle) 111*c* is formed between each ink tank 103 in the ink tank plate 112 side as a liquid supply plate 111. The drive circuit member 109 is arranged in the receipt concave portion 111*c*.

That is, the drive circuit member 109 is mounted in the mount area A on the ink tank plate 112 surrounded by the receipt concave portion 111*c* that does not penetrate from top to bottom of the liquid supply plate 111, and is hermetically sealed with the sealing material 110.

Figure 8A:
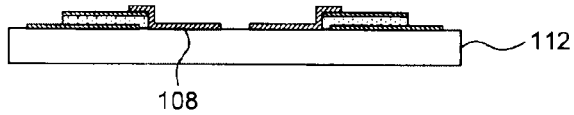
FIGS. 8A to 8D are schematic cross-sectional views illustrating a process of assembling an inkjet head according to the second embodiment.
Figure 8B:
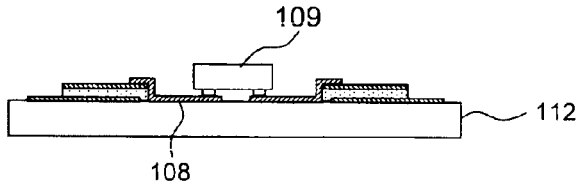

In order to assemble the aforementioned inkjet head 100B, as shown in FIG. 8B, the drive circuit member 109 is mounted on the ink tank plate 112 having the nozzle plate 101, the vibrating plate 104, the electromechanical transducer 106, and the extraction electrode 108 as shown in FIG. 8A.

Figure 8C:
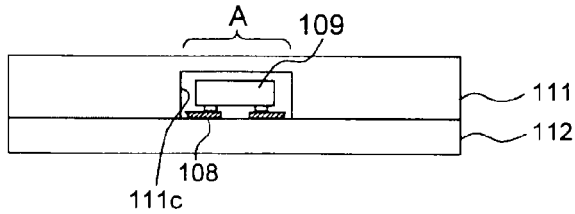

Then, the liquid supply plate 111 is bonded to the ink tank plate 112 from the upper side thereof as shown in FIG. 8C. As a result, a mount area A is formed on the ink tank plate 112 by means of the receipt concave portion 111*c* of the liquid supply plate 111, and the drive circuit member 109 is arranged in the mount area A.

Figure 8D:
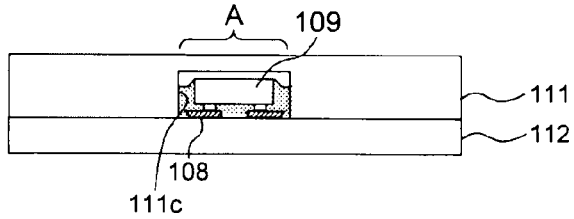

In this situation, as shown in FIG. 8D, the sealing material 110 is discharged from the sealing material supply needle, and fills the mount area A to hermetically seal the circumference including the electrical connections connected to the extraction electrodes 108 of the drive circuit member 109 using the sealing material 110 in the mount area A.

Here, in the inkjet head 100A according to the first embodiment, since the liquid supply plate 111 having the receptacle 111*b* penetrating from top to bottom is used, it is possible to easily fill the mount area A with the sealing material 110, starting from the opening in the upper side. In comparison to the first embodiment, in the inkjet head 100B according to the second embodiment, the upper side of the mount area A is blocked. Therefore, a filling hole (not shown) communicating between the external side and the mount area A is formed in such an inkjet head 100B, and the sealing material supply needle is inserted into the filling hole so as to fill the mount area A with the sealing material 110.

In addition, through the aforementioned assembling process, it is possible to easily and smoothly assemble the inkjet head 100B.

In the inkjet head 100B according to the second embodiment, since the sealing material 110 is provided for filling after the liquid supply plate 111 is bonded to the ink tank plate 112, it is unnecessary to provide the liquid supply plate 111 with a back clearance corresponding to the area where the sealing material 110 wetly spreads on the ink tank plate 112 when it is filled with the sealing material 110, compared to a case where the liquid supply plate 111 is bonded to the ink tank plate 112 after being filled with the sealing material 110. Therefore, it is possible to miniaturize the head and guarantee high reliability. Since the amount of materials is reduced due to the miniaturization, it is possible to reduce costs. Particularly, since miniaturization increases the number of components obtained per single wafer when components are cut out from a wafer, it is possible to reduce costs.

Third Embodiment

Next, an inkjet head according to a third embodiment will be described.

In the following description, same reference numerals denote same elements as in the inkjet head 100A according to the first embodiment, and description thereof will not be repeated.

Figure 9:
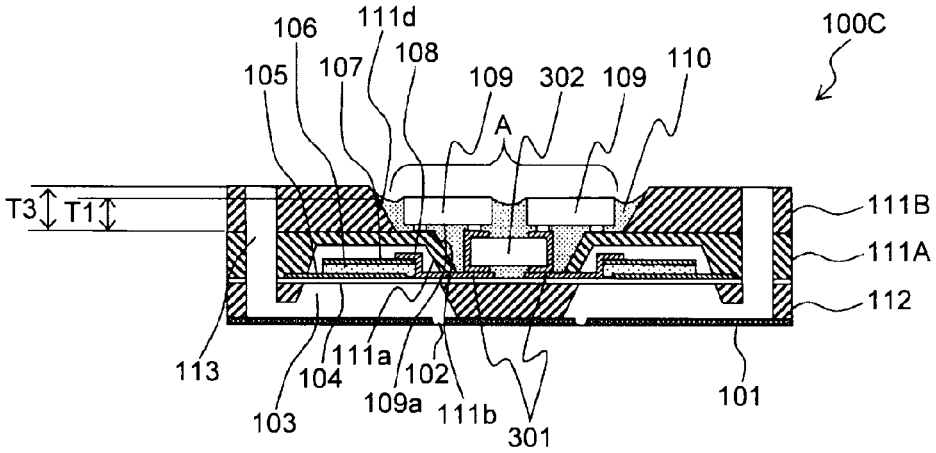
FIG. 9 is a cross-sectional view illustrating an inkjet head according to a third embodiment.

Referring to FIG. 9, an inkjet head 100C according to the third embodiment includes a first liquid supply plate (liquid supply plate) 111A stacked on and bonded to the ink tank plate 112 and a second liquid supply plate (liquid supply plate) 111B stacked on and bonded to the first liquid supply plate 111A. In addition, the inkjet head 100C includes two drive circuit members 109, and the drive circuit members 109 are electrically connected to the extraction electrodes 108 of the ink tank plate 112 through a wire connector (wiring member) 302 having wiring materials 301.

The second liquid supply plate 111B is provided in approximately the same layer as that of the layer on which the drive circuit member 109 is mounted. The second liquid supply plate 111B supplies a liquid such as ink to the ink tank 103 of the ink tank plate 112 through the viahole 113.

In the inkjet head 100C having such a stack structure, the second liquid supply plate 111B included in approximately the same layer as the layer on which the drive circuit member 109 is mounted is provided with a receptacle (receptacle hole) 111*d* penetrating from the top to the bottom. The drive circuit member 109 is arranged in the receptacle 111*d*. That is, the drive circuit member 109 is mounted in the mount area A on the first liquid supply plate 111A surrounded by the receptacle 111*d* of the second liquid supply plate 111B and hermetically sealed with the sealing material 110.

The thickness T1 of the drive circuit member 109 mounted in the mount area A is smaller than the thickness T3 of the second liquid supply plate 111B. As a result, the upper surface of the drive circuit member 109 is arranged to be lower than the upper surface of the second liquid supply plate 111B.

Similarly, in such an inkjet head 100C, the first liquid supply plate 111A and the second liquid supply plate 111B are sequentially stacked on and bonded to the ink tank plate 112, and the mount area A is filled with the sealing material 110 while the drive circuit members 109 are mounted using the wire connector 301 to hermetically seal the circumference including the electrical connections connected to the wire connector 302 of the drive circuit members 109.

That is, similarly, in the case of such an inkjet head 100C, since the sealing material 110 is provided for filling after the first liquid supply plate 111A and the second liquid supply plate 111B are bonded to the ink tank plate 112, it is unnecessary to provide the first liquid supply plate 111A and the second liquid supply plate 111B with a back clearance corresponding to the area where the sealing material 110 wetly spreads on the ink tank plate 112 when the sealing material 110 is provided to fill, compared to a case where the first liquid supply plate 111A and the second liquid supply plate 111B are bonded to the ink tank plate 112 after being filled with the sealing material 110. Therefore, it is possible to miniaturize the head and guarantee high reliability. Particularly, since miniaturization increases the number of components obtained per single wafer when components are cut out from a wafer, it is possible to reduce costs.

Similarly, in the inkjet head 100C, the thickness T1 of the drive circuit member 109 mounted in the mount area A is smaller than the thickness T3 of the second liquid supply plate 111B, and as a result, the upper surface of the drive circuit member 109 is arranged to be lower than the upper surface of the second liquid supply plate 111B. Therefore, in a case where a frame or the like is bonded to the top, it is unnecessary to provide the frame or the like with a back clearance for preventing contact with the drive circuit member 109. That is, it is possible to planarize the bonding surface of the bonded frame and the like. Therefore, it is possible to reduce the number of processes and lower costs.

Next, an image forming apparatus in which any one of the inkjet heads 100A to 100C can be mounted according to the first to third embodiments described above will be described.

Figure 10:
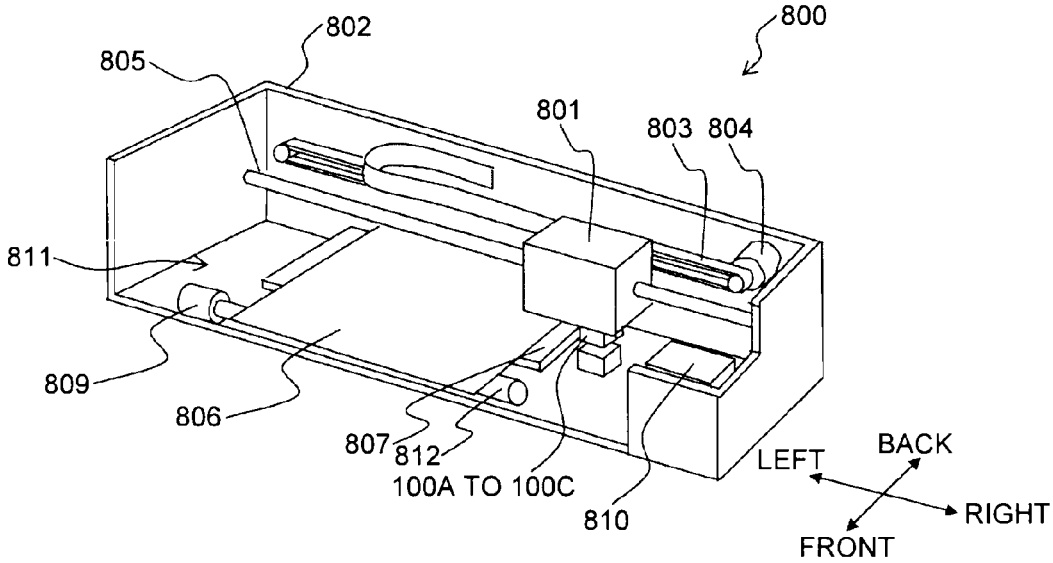
FIG. 10 is a schematic perspective view illustrating an internal structure of the image forming apparatus having the inkjet head according to an embodiment of the invention.

As shown in FIG. 10, an image forming apparatus 800 has a carriage 801. The carriage 801 is horizontally movably supported in the widthwise direction of the apparatus along a pillar 805 provided in a horizontal direction inside a casing 802.

The carriage 801 is wound by a belt 803, and the belt 803 is concatenated to a carriage motor 804. As the carriage motor 804 is rotated, the belt 803 is horizontally moved, and as a result, the carriage 801 is horizontally shifted.

The inkjet heads 100A to 100C may be mounted on the carriage 801, and the inkjet heads 100A to 100C mounted on the carriage 801 are horizontally shifted along with the carriage 801.

The image forming apparatus 800 further has a conveying mechanism 811 for conveying media 806 such as a paper sheet. The conveying mechanism 811 is provided with a platen 807 that supports the conveyed medium 806, a sheet transfer roller 812 that sends the medium 806, and a feed motor 809 that rotates the sheet transfer roller 812. In addition, the conveying mechanism 811 conveys the medium 806 in a direction perpendicular to the movement direction of the carriage 801 by rotating the sheet transfer roller 812 using the feed motor 809 while the medium 806 is supported by the platen 807.

In the image forming apparatus 800 configured in such a manner, droplets are discharged from the inkjet heads 100A to 100C to the medium 806 based on the image data transmitted from a control unit (not shown) while the carriage 801 is shifted in one direction of left or right, and the medium 806 is moved forward in a desired distance. Then, droplets are discharged from the inkjet heads 100A to 100C to the medium 806 based on the image data transmitted from the control unit (not shown) while the carriage 801 is shifted to the other direction in turn. By repeating such operations, a desired image is formed on the medium 806.

In addition, one movement end of the carriage 801 is provided with a maintenance device 810. The carriage 801 stands by on the maintenance device 810 while no print is performed. The maintenance device 810 absorbs ink from the inkjet heads 100A to 100C, recovers the nozzles 102 that may be clogged and incapable of discharging a liquid such as ink, caps the inkjet heads 100A to 100C to enclose the nozzles 102, or dries a liquid such as ink to prevent discharge errors of the liquid that may be generated when the nozzles 102 are clogged.

In the image forming apparatus 800 described above, since any one of the inkjet heads 100A to 100C according to the first to third embodiments that has achieved miniaturization, reduced costs, and high reliability can be mounted on the carriage 801, the image forming apparatus 800 itself can achieve miniaturization, reduced costs, and high reliability.

The embodiments may be applicable to overall components necessary to mount and seal electronic components such as ICs in a space or a trench that may be generated when a stack member is bonded.

In addition, although the aforementioned embodiments are preferred examples of the invention, they are not intended to limit the invention, but may be variously modified without departing from the spirit and scope of the invention.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An inkjet head comprising:

an ink tank plate that includes a nozzle configured to discharge a liquid and a first and a second ink tank of which a portion is formed by a vibrating plate provided with an electromechanical transducer;

a drive circuit member connected to the electromechanical transducer through a wiring member to apply a voltage to the electromechanical transducer so as to generate a pressure in the first and second ink tanks to discharge a liquid from the nozzle;

a liquid supply plate stacked approximately in parallel with the drive circuit member on the ink tank plate to guide a liquid to the first and second ink tanks; and a sealing material that hermetically seals an electrical connection between at least the drive circuit member and the wiring member, wherein the liquid supply plate is configured to be bonded to the ink tank plate so as to be flush with an upper surface of the ink tank plate where the drive circuit member is mounted, and the liquid supply plate includes a concave portion being formed in a location corresponding to the electromechanical transducer in the ink tank plate side, and the electromechanical transducer is received by the concave portion, wherein the liquid supply plate further includes a receptacle hole formed between the first and second ink tanks, and the drive circuit member is arranged inside the receptacle hole, and wherein the drive circuit member has a thickness smaller than the thickness of the liquid supply plate.

2. The inkjet head according to claim 1, wherein the drive circuit member is bonded to the electromechanical transducer through a wiring member using a flip chip bonding technique.

3. The inkjet head according to claim 1, wherein the sealing material is curable at a low temperature.

4. The inkjet head according to claim 1, wherein the drive circuit member is hermetically sealed by the sealing material at a temperature lower than a temperature used to mount the drive circuit member, after the drive circuit member is mounted and the liquid supply plate is bonded.

5. An image forming apparatus comprising the inkjet head according to claim 1.

* * * * *